US005560581A

United States Patent [19]

Cassone

[11] Patent Number: 5,560,581

[45] Date of Patent: Oct. 1, 1996

[54] HINGED BASE FOR A SHORING STRUT FOR USE IN CONSTRUCTION AND STEEL STRUCTURAL WORK

[75] Inventor: Luigi Cassone, Taranto, Italy

[73] Assignee: IDROS S.R.L., Taranto, Italy

[21] Appl. No.: 360,064

[22] Filed: Dec. 20, 1994

[30] Foreign Application Priority Data

Dec. 22, 1993 [IT] Italy ..... NRM93230 U

[51] Int. Cl.[6] ..... F16M 13/00

[52] U.S. Cl. ..... 248/516; 248/351; 248/357; 248/52

[58] Field of Search ..... 248/159, 351, 248/357, 516, 521

*Primary Examiner*—Ramon O. Ramirez

*Assistant Examiner*—Michael J. Turgeon

*Attorney, Agent, or Firm*—Browdy and Neimark

[57] ABSTRACT

The hinged support base comprises a support element shaped semicubically and exhibiting two quadrilateral faces, which are of like dimensions, two triangular faces, of like dimensions, a diagonal face affording a hemispherical cavity, and a terminal element exhibiting a head portion which is partially spherical and which is housable in the hemispherical cavity. The hemispherical cavity of the support element exhibits a plurality of partially cylindrical recesses. The support element further comprises a lock-tooth for the head portion. The support element also exhibits elongate projections on each quadrilateral face thereof and isolated projections on each triangular face thereof; and further exhibits a plurality of holes for connecting screws for connection thereof to at least one like support element.

5 Claims, 4 Drawing Sheets

FIG11
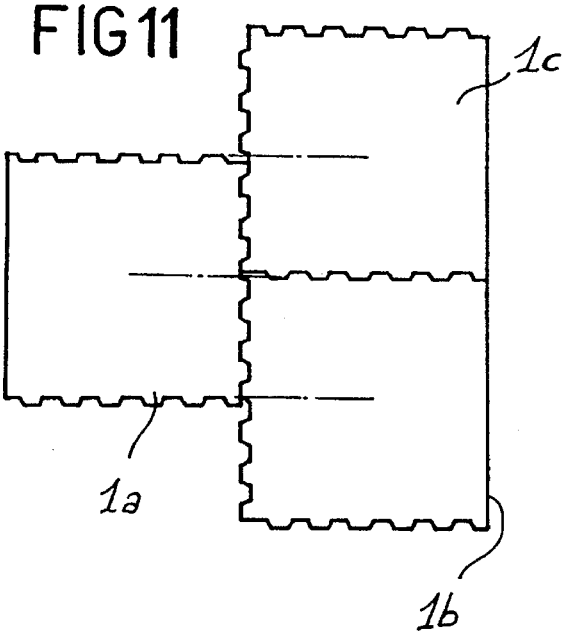
FIG9
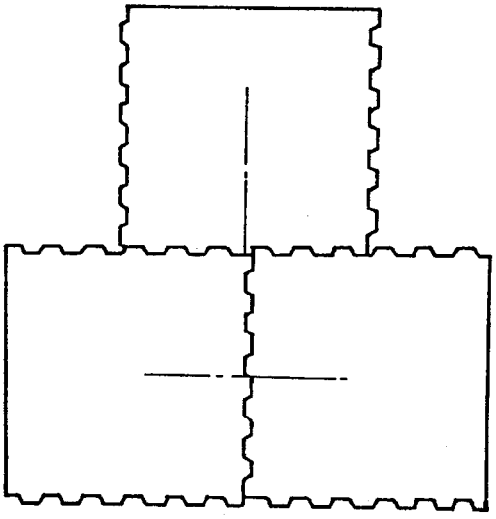
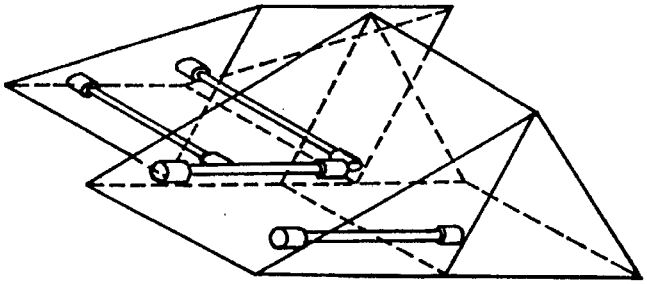
FIG10
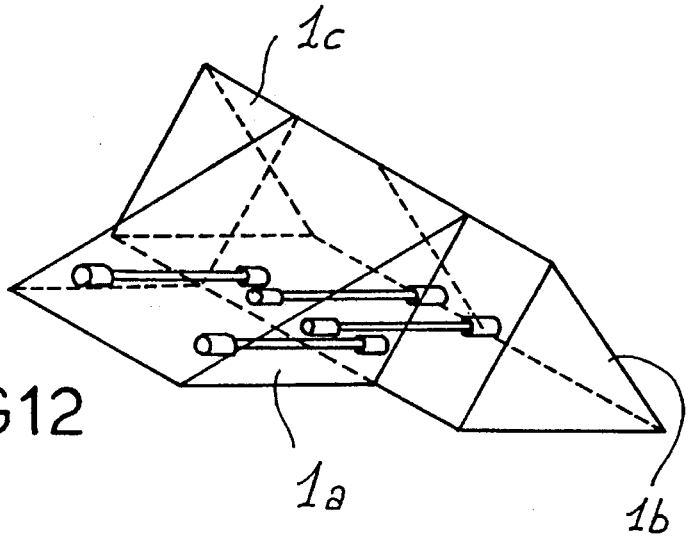
FIG12

HINGED BASE FOR A SHORING STRUT FOR USE IN CONSTRUCTION AND STEEL STRUCTURAL WORK

BACKGROUND OF THE INVENTION

1. Technical Field

The invention relates to a hinged base for a shoring strut for use in construction and steel structural work.

It particularly relates to a hinged base for perpendicular and inclined metal shoring struts, comprising a ball joint with a wide solid angle rotation range. The components of such hinges are a support element in contact against a structure to be shored and a head removably (so that the ball joint elements can be separated) housed in a seat afforded in the base element and connectable to a shore.

2. Prior Art

Ball hinge joints exist in the prior art, though none of them are directly applicable to shores. In these prior art solutions, the removability of the head from the ball seat is achieved in various ways. For example, in patent DE 37 30 678 A1, a type of ball joint hinge is used in which the support element exhibits a substantially cylindrical seat bordered by removable pivots. Patent DE 18 90 440 exhibits a ball-joint for rod linkages, comprising two side-by-side rigid semi-housings together forming a spherical seat, which semihousings are held removably together by means of a sleeve-coupling. DE 40 41 939 exhibits a ball seat realized internally of a support element and is made with a plastically deformable metal shell; a plastic gasket being interposed between the support element and the ball head. DE 31 32 824 discloses a ball seat made by means of a pair of coaxial sleeves and a holed plate.

While none of the above-mentioned ball-joints are truly applicable in the construction industry for forming a shoring base, Italian patent for Utility Model no. TA91U000003, entitled "Components for Realizing Wide-angle Shorings for Building Structures", by the same applicant, partially satisfies said requirement. The components of the above patent comprise: a shore exhibiting at one end a coupling zone; a terminal element composed of a spherical portion, a cylindrical portion and a coaxial tang which can be jointed in the corresponding end of the shore; a straight prismatic triangular support element, basically semi-cubically shaped, provided with a hemispherical cavity in its diagonal face which functions as a ball-joint seat for the above-mentioned terminal element.

In the above patent, the terminal element and the support element together constitute the base of the shore. The terminal element is inclinable through a wide angle so that the resulting shoring strut can be perpendicular or inclined, while the support base exhibits a multiplicity of trihedrons, each of which presents a face acting as a rest surface for the shoring zone (the contact surface) and two more faces, perpendicular to the first face and acting as bucks to the contact surface. The bucking surfaces are in contact with the dihedron or trihedron constituting the structure to be shored, for example a floor and one or two walls, or with the surfaces of other like support elements meeting in a complex shoring strut arrangement.

The above-described patent exhibits some drawbacks, however, not so much from the functional point of view as from that of the difficulties encountered in the installation of the bases of the shore, especially when a base is applied to a ceiling or in general to a projecting structure. These difficulties are due to the instability of the relationship between the terminal element and the support element due to the fact that the portion of head of the former is simply housed and not constrained solidly in the seat of the latter. Further, it is impossible to achieve a blocking of single support elements which will be associated together in a same complex shoring joint arrangement, as mentioned above.

Other drawbacks encountered in the above-mentioned patent are connected with the functionability of the support base, such as its inability to deal with tangential forces which might build up on the active surfaces (that is, the contact and bucking surfaces) of the shorings.

OBJECT OF THE INVENTION

The main aim of the present invention is thus to obviate the above-mentioned drawbacks.

In particular, one aim of the present invention is to provide a perpendicular or inclined shore wherein the support base of the shore permits a greater inclination of the shore with respect to the contact surface comprising the shoring zone. A further aim of the present invention is to provide a perpendicular or inclined shore wherein the bases of said shores allow for a dismounting not only between the terminal element and the shore, but also between the base and the terminal element.

A further aim of the present invention is to permit a perpendicular and inclined shoring, in particular of a complex type, in which the support bases of one branch point can be previously connected up in the configuration and setting necessary for their chosen shoring task.

A still further aim of the present invention is to permit a normal or inclined shoring, in which the support base is provided with means able to resist tangential forces which might otherwise cause undesired slippage of the bases from the shoring point desired.

SUMMARY OF THE INVENTION

To the above end, the invention, as it is characterized in the claims that follow, solves the problem of providing a hinged support base for shores in construction and steel structural work by providing a base comprising a support element shaped semicubically and exhibiting two quadrilateral faces, which are of like dimensions, two triangular faces, of like dimensions, a diagonal face affording a hemispherical cavity, and a terminal element exhibiting a cylindrical portion for connection with an end of a shore strut and a head portion which is partially spherical and which is housable in the hemispherical cavity of the support element such as to realize, between the support element and the terminal element, a ball-joint having a wide angle of rotation.

The base is characterized in that: the hemispherical cavity of the support element further exhibits a plurality of partially cylindrical recesses connected with the cylindrical portion of the terminal element, which cylindrical recesses increase the possible angle of rotation achievable by the terminal element. The support element also comprises a lock-tooth for the head portion of the terminal element, screw-mounted to and removable from the diagonal face between two consecutive of the partially cylindrical recesses in the hemispherical cavity. The lock-tooth has such conformation as to connect continuously with the hemispherical cavity.

The support element has bevelled edges and, as resistors to tangential sliding of said element, on each square face of the support element there are elongate projections obtained by a presence of a series of parallel channels which are equidistant from and perpendicular to a common edge. Each triangular face has single projections obtained from a double, mutually perpendicular series of channels, each parallel to one of the edges meeting in a right-angle. The channels of one of the quadrilateral faces and of one of the triangular faces are mutually staggered by a distance equal to a breadth of one channel with respect to the channels of the other square and triangular faces. The support element also presents a plurality of threaded holes for receiving connecting screws for connection of the support element to at least one other like support element.

BRIEF DESCRIPTION OF THE DRAWINGS

Further characteristics and advantages of the present invention will better emerge from the detailed description that follows, of an embodiment of the invention, illustrated in the form of the a non-limiting example in the accompanying drawings, in which:

FIGS. 9 and 10 are schematic views, respectively plan and perspective, of three bases according to the invention, associated in a first example of a complex branch point;

FIGS. 11 and 12 are schematic perspective plan views of three bases according to the invention, associated in a second example of a complex branch point.

DETAILED DESCRIPTION OF THE PREFERRED EMBODIMENT(S) OF THE INVENTION

Figure 3:
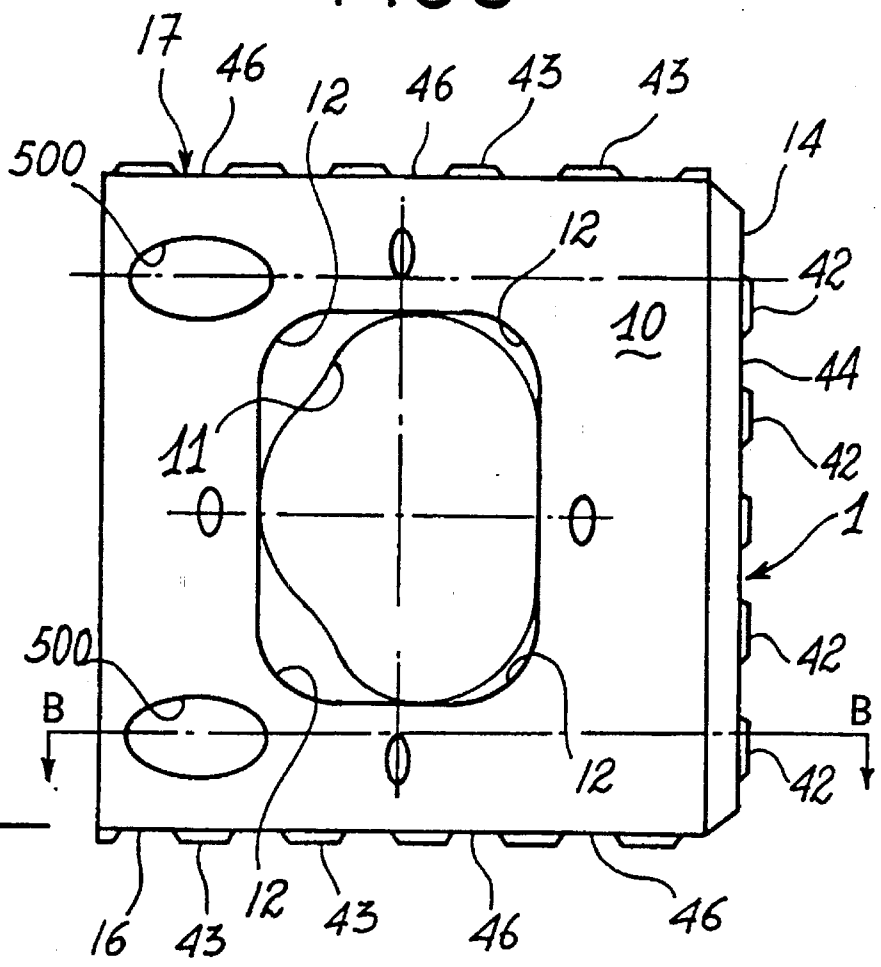
FIG. 3 is a plan view-from above of the support element of FIG. 1.

In the figures, 1 denotes a support element, while 2 denotes a terminal element and 3 a lock tooth of the terminal element 2 in the support element 1. These three elements, made preferably in a diecast alloy, constitute together with the fixing screws (which will be described hereinbelow), the rest base for shoring struts according to the present invention.

The support element 1, for reasons connected with assembly thereof (better described hereinbelow), is preferably though not necessarily semicubically shaped. A hemispherical cavity 11 is afforded on the diagonal face 10 of the support element 1 (see FIGS. 3 and 6).

Figure 7:
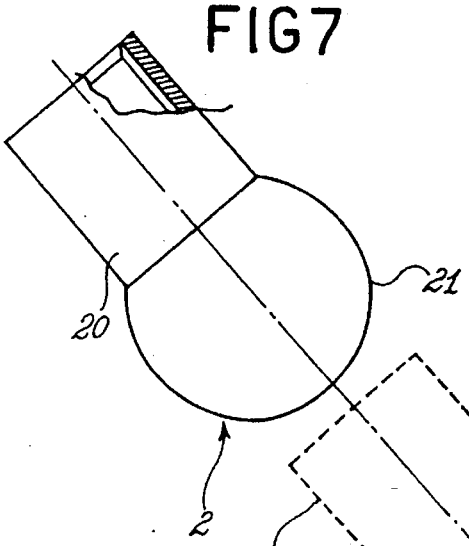
FIG. 7 is a partially-sectioned lateral view of the terminal element of the base according to the invention.

The terminal element 2 (FIGS. 6 and 7) has a cylindrical portion 20 and a partially spherical head portion 21. The cylindrical portion 20 has the function of connecting the terminal element 2 with the end of a shore strut (not shown in the figures). To this end, the cylindrical portion 20 is tubular and internally threaded, even if, obviously, other constructional solutions can be employed to realize the above-mentioned connection.

The head portion 21 is housable in the cavity 11 of the support element 1 to realize, between the support element 1 and the terminal element 2, a ball joint having a wide solid rotation angle. Thus, the spherical diameter Ds of the cavity 11 and the spherical diameter Dt are very similar, so that the ball-joint is realizable.

Figure 6:
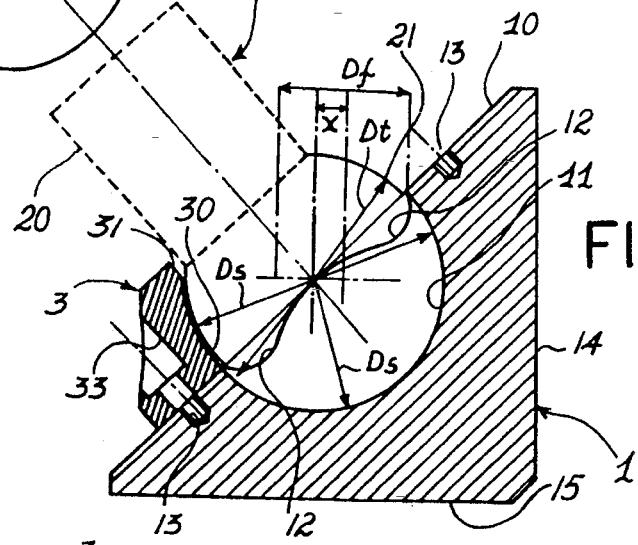
FIG. 6 is a section made along line C—C of FIG. 5, in which, to illustrate the whole support base, a lock tooth for the terminal element is represented in section, as well as the terminal element itself, the latter in a broken line.
Figure 8:
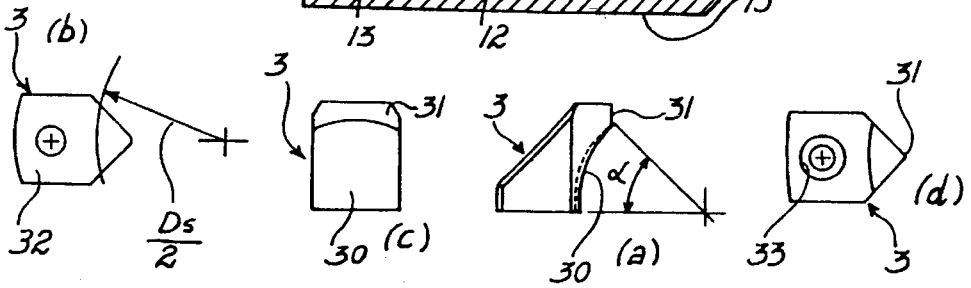
FIGS. 8*a*, 8*b*, 8*c* and 8*d* are respectively: a vertical view of the lock tooth of FIG. 6, a plan view from below, a lateral view and a play view from above thereof.

In the support base according to the invention, the cavity 11 of the support element 1 is further widened peripherically by a presence of a plurality of partially cylindrical recesses 12, four in the embodiment shown. The cylindrical recesses 12 are preferably made with a ball-end two-fluted mill having diameter Df (FIG. 6). Each recess 12 is realized out of alignment to a degree x, measured in a horizontal plane with reference to the center of the hemispherical cavity 11.

The lock tooth 3 of the head portion 21 of the terminal element 2 is mounted removably on the diagonal face 10 of the support element 1 (see FIG. 6). FIGS. 8*a*, 8*b*, 8*c*, and 8*d* show how the lock tooth 3 exhibits a spherical sector, for example a total length corresponding to angle alpha of 45 degrees, in its concave portion 30. The concave portion 30 is shaped and positioned such as to provide a continuation the diameter Ds of the cavity 11, and at the point where its concave portion terminates, it provides a small cylindrical frontal portion 31 destined to function as an endrun striker for the cylindrical portion 20 of the terminal element 2. The lock tooth 3 has a flat base 32 destined to rest on the diagonal face 10 of the support element 1, adjacent to the cavity 11 and between two consecutive partially cylindrical recesses 12, 12.

The lock tooth 3 is rigidly and removably constrained by a screw (not shown in the figures) housed in a through hole 33 and screwable in one of at least four threaded holes 13 made in relatively equidistant positions on the diagonal face 10 of the support element 1, adjacent to the cavity 11 (FIGS. 3, 6). The choice from the four threaded holes 13 in which the lock tooth 3 is screwable depends on the requirement for degree of inclination between the terminal element 2 and the support element 1.

Figure 1:
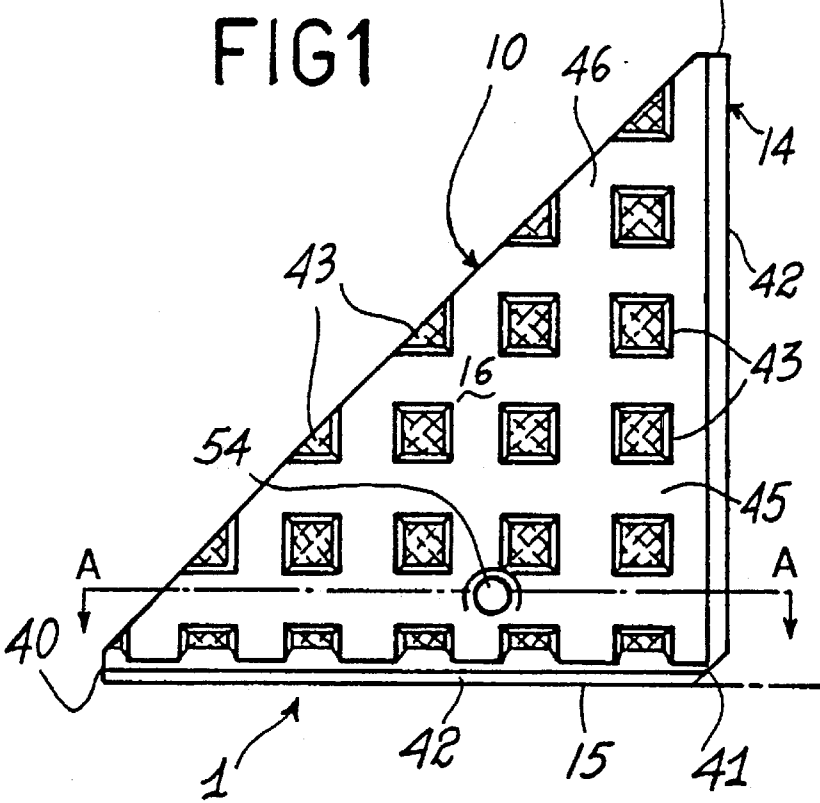
FIG. 1 is a lateral view of a support element of the base according to the present invention.
Figure 4:
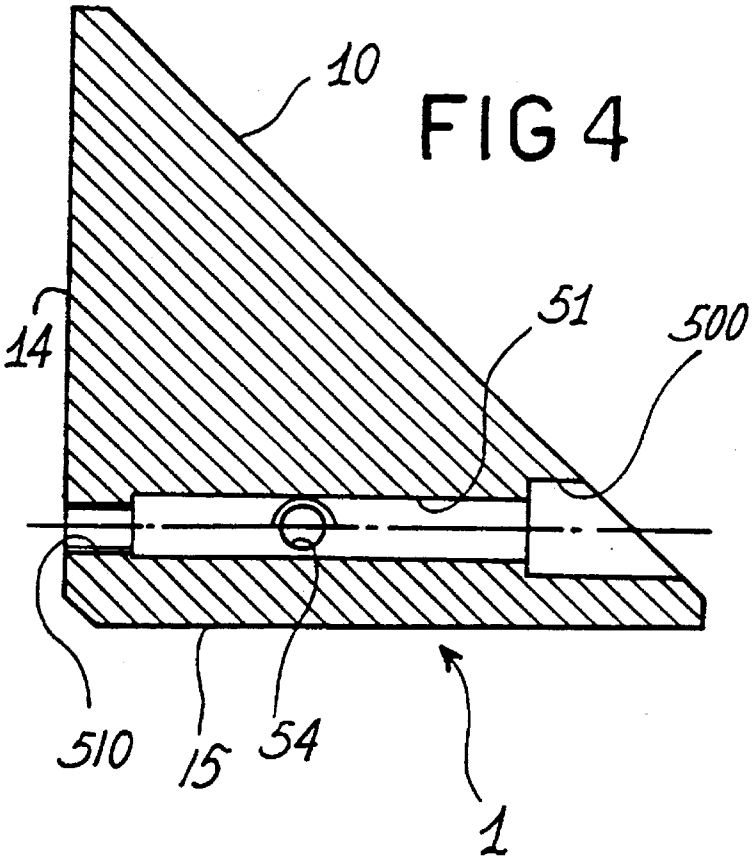
FIG. 4 is a section made along line B—B of FIG. 3.

The support element 1 exhibits bevelled edges 40, 41 (as shown in FIGS. 1 and 3), preferably at 45 degrees so as to obviate the danger of injury to operators when handling, and to facilitate gripping with vices during working, as well as in order to have better contact if the support element 1 is positioned in contact with the dihedron or trihedron constituted by the structure to be shored. Further, the support element 1, in order to resist possible tangential slippage forces which might obtain after positioning of the base, exhibits a plurality of projections, possibly milled (illustrated with a broken line in the figures). These projections preferably comprise elongate projections 42 in the quadrilateral faces 14, 15, and isolated projections 43 in the triangular faces 16, 17.

Advantageously, the elongate projections 42 can be realized by a series of parallel channels 44, equidistant and perpendicular to a common edge between each quadrilateral face 14, 15 of the semicube of the support element 1. The isolated projections 43 are advantageously realized in a truncopyramidal shape and project from a lattice arrangement created by a double series of mutually-perpendicular channels 45, 46, each of said series being parallel to one of the edges of the two non-diagonal quadrilateral faces of the support element 1. The parallel channels 44 of one quadrilateral face 14 and respectively the channels 45, 46 of a triangular face 16 are staggered by a space corresponding to a breadth of one channel, with respect to the parallel channels 44 of the other quadrilateral face 15 and respectively the channels 45, 46 of the other triangular face 17.

Thanks to the to the presence of the elongate projections 42, or rather thanks to the staggered parallel channels 44, as described above, it is possible to interconnect a plurality of elements at the quadrilateral faces, as shown in the two examples in figures from 9 to 12, in which the inclined faces of the support elements 1*a*, 1*b* and 1*c* are free to receive the terminal elements for shoring struts (not shown).

In this way, with the staggered channels, relative slippage between support elements is avoided. Thanks to the isolated projections 43, or rather thanks to the double series of mutually perpendicular channels 45, 46, it is possible for separate support elements 1 to be placed together with sufficient friction force, and to adhere sufficiently against zones of structures which are being shored thereby.

To stabilize the coupling between support elements 1, each of said support elements 1 is provided with a plurality of threaded holes for connecting screws with at least one other like support element.

Advantageously, the plurality of holes in the support element 1 comprises at least a first pair of through holes 50, 51, at least a first pair of threaded dead holes 52, 53, and at least a second pair of threaded dead holes 54, 55.

Figure 2:
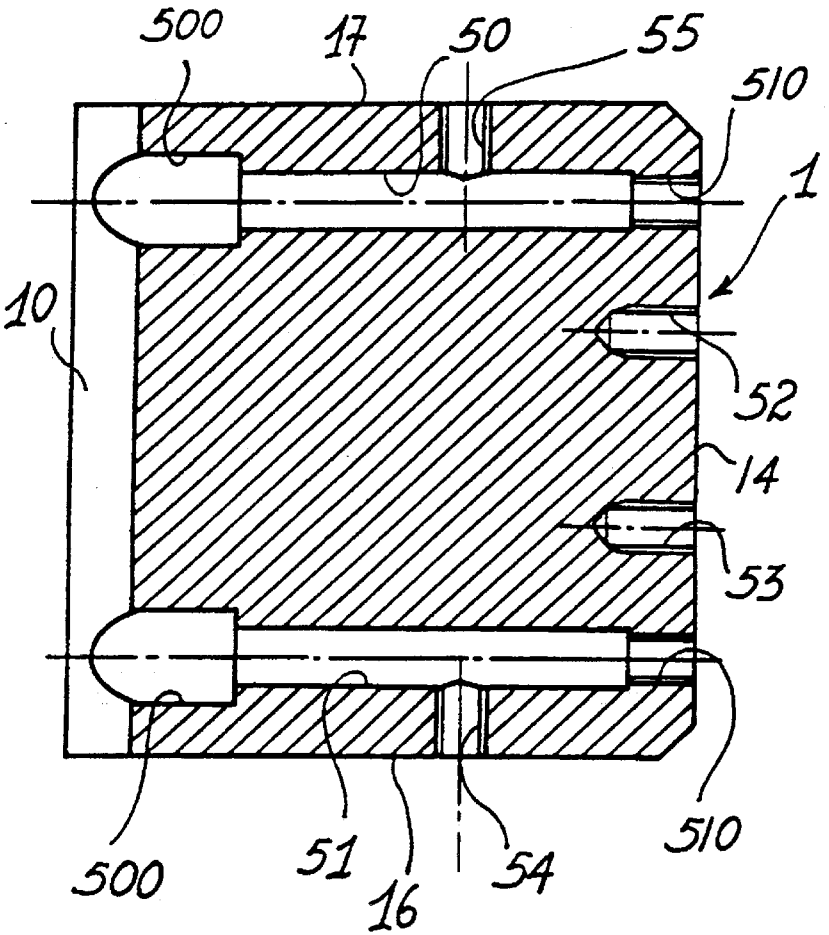
FIG. 2 is a section made according to the line A—A of FIG. 1.
Figure 5:
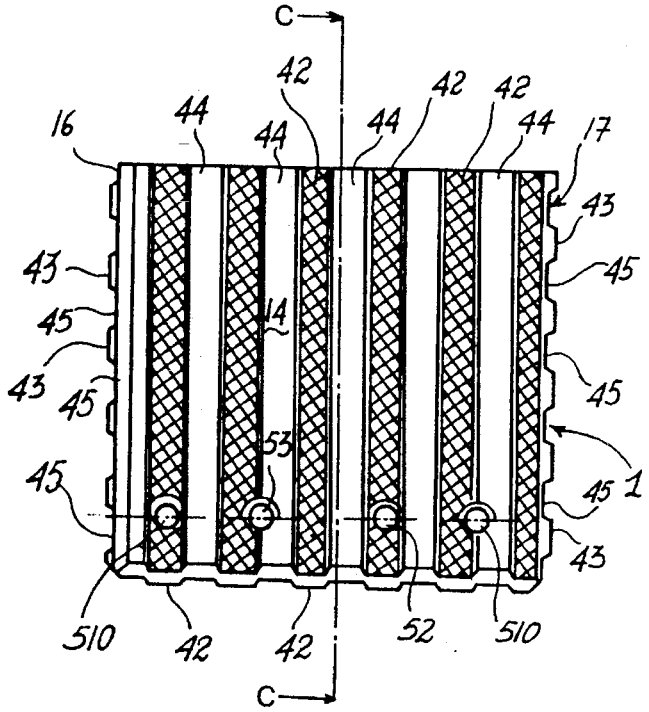
FIG. 5 is a lateral view from the right of the support element of FIG. 1.

The holes, 50, 51, 52, 53, 54, 55 preferably have their axes lying in a same plane parallel to a quadrilateral face, for example 15, as shown in FIGS. 1 and 2. The through holes 50, 51, are parallel and have one end 500 having a greater diameter at the diagonal face 10 and a smaller diameter at the threaded opposite end 510. The holes 50, 51 can thus singly receive a screw (not shown), preferably a hex-headed screw, possibly with only one end portion threaded, to screw into the threaded end 510 of the support element 1*a* after having crossed it, and thus in the threaded end 510 of a support element 1*b* as shown in FIG. 10. The threaded dead holes 52, 53 are parallel (FIGS. 2 and 5) and are made in proximity of the threaded ends 510 of the through holes 50, 51, such as singly to receive a through screw as shown in the coupling of FIG. 12, among 1*a*, 1*b* and 1*c*.

The threaded dead holes 54, 55 (FIGS. 1 and 2) are made coaxially on the opposite triangular faces 16, 17 of the support element 1 to permit a connection between the support element 1*c* and the elements 1*a* and 1*b* of FIG. 10.

Thanks to this connection, the shores can be predisposed on the respective bases and loaded against the interested structures by means of hydraulic jacks (not shown in the figures but obvious to a skilled technician).

I claim:

1. A hinged support base for shoring struts in construction and steel structural work comprising a support element (1) shaped semicubically and exhibiting two quadrilateral faces (14, 15), which are of like dimensions, two triangular faces (16, 17), of like dimensions, and a diagonal face (10), which diagonal face affords a hemispherical cavity (11);

said hinged support base further comprising a terminal element (2) exhibiting a cylindrical portion (20) for connection with an end of a shoring strut and a head portion (21) which is partially spherical and housable in the hemispherical cavity (11) of the support element (1) such as to realize, between the support element (1) and the terminal element (2), a ball-joint having a wide angle of rotation wherein;

the hemispherical cavity (11) of the support element (1) is peripherally widened thanks to a presence of a plurality of partially cylindrical recesses (12) corresponding in shape with the cylindrical portion (20) of the terminal element (2);

said support element (1) further comprises a lock-tooth (3) for the head portion (21) of the terminal element (2), mounted to and removable from the diagonal face (10) between two consecutive of the plurality of partially cylindrical recesses (12) in the hemispherical cavity (11); said lock-tooth (3) being of such a conformation as to provide a continuation of a circumference curvature of the hemispherical cavity (11);

the support element (1) exhibits elongate projections (42) on each of said two quadrilateral faces (14, 15) of support element (1), said elongate projections (42) being obtained through a presence on each of said two quadrilateral faces (14, 15) of a series of parallel channels (44) equidistanced from and perpendicular to an edge of the support element (1) which is common to each of the two said quadrilateral faces (14, 15), while each of the two triangular faces (16, 17) of the support element (1) exhibits isolated projections (43) obtained from a double series of mutually perpendicular channels (45, 46) in each of the said two triangular faces (16, 17), each said mutually perpendicular series of channels (45, 46) being parallel to an edge of one of said two quadrilateral faces (14, 15); said elongate projections (42) and said series of parallel channels (44), and said mutually perpendicular channels (45, 46) and said isolated projections (43) providing resistance to slippage due to tangential forces which the support element (1) may be subject to;

the parallel channels (44) of one of the two quadrilateral faces (14, 15) and the mutually perpendicular channels (45, 46) of one of the two triangular faces (16, 17) being staggered by a distance equal to a breadth of one of the parallel channels (44) and mutually perpendicular channels (45, 46) with respect to the parallel channels (44) and mutually perpendicular channels (45, 46) of the other of the two quadrilateral faces (14, 15) and two triangular faces (16, 17);

the support element (1) also exhibiting a plurality of threaded holes for receiving connecting screws for connection to at least one other like support element (1).

2. A hinged support base, as in claim 1, wherein the plurality of holes in the support element (1) comprises at least four threaded holes (13) made in equidistant positions on the diagonal face (10) of the support element (1), said four threaded holes (13) being adjacent to the hemispherical cavity (11).

3. A hinged support base, as in claim 1, wherein the plurality of holes in the support element (1) comprises at least one pair of through holes (50, 51) having axes which are parallel and coplanar and which are in a parallel plane to one of the two quadrilateral faces (14, 15); at least a first pair of threaded dead holes (52, 53) having axes which are parallel and coplanar to the axes of said at least one pair of through holes (50, 51); and at least a second pair of threaded dead holes (54, 55) having axes which are coplanar and perpendicular to the axes of said at least one pair of through holes (50, 51); each of said at least one pair of through holes (50, 51) exhibiting one end (500) having a greater diameter at the diagonal face (10) of the support element (1) and an opposite threaded end (510), said first pair of threaded blind holes (52, 53) being situated in proximity of the threaded end (510) of the through holes (50, 51) and said second threaded blind holes (54, 55) being made coaxially in the opposite triangular faces (16, 17) of the support element (1).

4. A hinged support base, as in claim 1, wherein the cylindrical portion (20) of the terminal element (2) is tubular and internally threaded.

5. A hinged base, as in claim 1, wherein the cylindrical portion (20) of the terminal element (2) is tubular and externally threaded.

* * * * *